US009272196B2

(12) United States Patent
Kropff et al.

(10) Patent No.: US 9,272,196 B2
(45) Date of Patent: Mar. 1, 2016

(54) DOUBLE-SIDED HOME PLATE

(71) Applicants: Chad Kropff, Roanoke, VA (US); Catherine Kropff, Roanoke, VA (US)

(72) Inventors: Chad Kropff, Roanoke, VA (US); Catherine Kropff, Roanoke, VA (US)

(73) Assignee: Bulldog Field Equipment, LLC, Roanoke, VA (US)

( * ) Notice: Subject to any disclaimer, the term of this patent is extended or adjusted under 35 U.S.C. 154(b) by 47 days.

(21) Appl. No.: 14/150,225

(22) Filed: Jan. 8, 2014

(65) Prior Publication Data

US 2014/0194229 A1 Jul. 10, 2014

Related U.S. Application Data

(60) Provisional application No. 61/750,099, filed on Jan. 8, 2013.

(51) Int. Cl.
*A63B 71/00* (2006.01)
*A63B 69/00* (2006.01)

(52) U.S. Cl.
CPC ..... *A63B 69/0013* (2013.01); *A63B 69/0002* (2013.01); *A63B 2209/10* (2013.01); *A63B 2243/0004* (2013.01)

(58) Field of Classification Search
CPC ..... A63B 69/0013; A63B 69/0002; A63B 63/00; A63C 19/04
USPC ..... 473/422, 451, 452, 497–501
See application file for complete search history.

(56) References Cited

U.S. PATENT DOCUMENTS

| | | | | |
|---|---|---|---|---|
| 2,122,266 | A * | 6/1938 | Seys | A63C 19/04 473/499 |
| 2,138,273 | A | 11/1938 | Goodrick | |
| 3,341,199 | A * | 9/1967 | Madsen | A63C 19/04 473/499 |
| 3,508,747 | A | 4/1970 | Orsatti | |
| 3,572,705 | A | 3/1971 | Wyble | |
| 4,266,768 | A | 5/1981 | Hall | |
| 4,448,414 | A | 5/1984 | Gutierrez | |
| 4,531,733 | A | 7/1985 | Hall | |
| 4,591,154 | A | 5/1986 | Santarone | |
| 5,203,557 | A | 4/1993 | Studebaker et al. | |
| 5,350,172 | A * | 9/1994 | Garrett | A63B 69/0002 473/454 |
| 6,688,996 | B1 | 2/2004 | Mitani | |
| D528,180 | S | 9/2006 | Rathbun | |
| D534,232 | S | 12/2006 | Rathbun | |

(Continued)

OTHER PUBLICATIONS

"Bolco (300-AS) Homeplate", Tomark Sports, www.tomark.com/Baseball-Softball/display.php?Category=126&Product=1322&pn=Bolco+%28300-AS%29+Homeplate, available at least as early as Dec. 2012.

(Continued)

*Primary Examiner* — Mitra Aryanpour
(74) *Attorney, Agent, or Firm* — New River Valley IP Law, P.C.; Michele L. Mayberry

(57) ABSTRACT

The present invention relates to home plates for ball fields, such as softball and baseball fields. Embodiments of the invention provide a double-sided home plate. Double-sided home plates according to embodiments can comprise a support base with two opposing recesses each shaped to receive a home plate insert, with a home plate insert fixed in each recess. Also provided is an improved home plate comprising two identical sides so when one side is worn due to use all that is required is to invert the home plate to expose a new surface.

11 Claims, 4 Drawing Sheets

(56) References Cited

U.S. PATENT DOCUMENTS

| | | | |
|---|---|---|---|
| 7,648,432 | B1 | 1/2010 | Hall |
| 7,717,813 | B2 | 5/2010 | Sinovich |
| 8,043,175 | B2 | 10/2011 | Chen |
| 8,070,631 | B2 | 12/2011 | Nimmons |
| D653,502 | S | 2/2012 | Mitchell |
| 2004/0005942 | A1 | 1/2004 | Wang |
| 2008/0194361 | A1 | 8/2008 | Hadar |
| 2009/0124436 | A1 | 5/2009 | Nimmons |
| 2010/0210382 | A1 | 8/2010 | Clark |
| 2010/0279802 | A1 | 11/2010 | Sinovich |

OTHER PUBLICATIONS

"Bolco (310-SHP) Homeplate", Tomark Sports, www.tomark.com/Baseball-Softball/display.php?Category=126&Product=2515 &pn=Bolco+%28310-SHP%29+Homeplate, available at least as early as Dec. 2012.

"Bolco All Play Home Plate", Beacon Athletics, store.beaconathletics.com/home-plates/bolco-all-play-home-plate/, available at least as early as Dec. 2012.

"Economy Home Plate", Beacon Athletics, store.beaconathletics.com/home-plates/economy-home-plate/, available at least as early as Dec. 2012.

"Enduro Bury-In Homeplate", Tomark Sports, www.tomark.com/Baseball-Softball/display.php?Category=126&Product=3238 &pn=Enduro+Bury-In+Homeplate, available at least as early as Dec. 2012.

"Hollywood (SRHP) Homeplate", Tomark Sports, www.tomark.com/Baseball-Softball/display.php?Category=126&Product=1005 &pn=Hollywood+%28SRHP%29+Homeplate, available at least as early as Dec. 2012.

"Hollywood Bury-All", Beacon Athletics, store.beaconathletics.com/home-plates/hollywood-bury-all/, available at least as early as Dec. 2012.

"Hollywood Homeplate", Tomark Sports, www.tomark.com/Baseball-Softball/display.php?Category=126&Product=7486 &pn=Hollywood+Homeplate, available at least as early as Dec. 2012.

"Hollywood MLB Pro Style Home Plate", Beacon Athletics, store.beaconathletics.com/home-plates/hollywood-mlb-pro-style-home-plate/, available at least as early as Dec. 2012.

"MacGregor® Major League Home Plate", BSN Sports, www.bsnsports.com/macgregorr-major-league-home-plate, available at least as early as Dec. 2012.

"MacGregor® Wood-Filled Home Plate", BSN Sports, www.bsnsports.com/macgregorr-wood-filled-home-plate, available at least as early as Dec. 2012.

"Max All Play Home Plate", Beacon Athletics, store.beaconathletics.com/home-plates/max-all-play-home-plate/, available at least as early as Dec. 2012.

"Roger's One Time Home Plate", Tomark Sports, www.tomark.com/Baseball-Softball/display.php?Category=126&Product=7479 &pn=Roger%27s+One+Time+Home+Plate, available at least as early as Dec. 2012.

"Schutt Bury-All", Beacon Athletics, store.beaconathletics.com/home-plates/schutt-bury-all/, available at least as early as Dec. 2012.

"Schutt Pro Home Plate", Beacon Athletics, store.beaconathletics.com/home-plates/schutt-pro-home-plate/, available at least as early as Dec. 2012.

* cited by examiner

DOUBLE-SIDED HOME PLATE

CROSS-REFERENCE TO RELATED APPLICATIONS

The present application relies on the disclosure of and claims priority to and the benefit of the filing date of U.S. Provisional Application No. 61/750,099, filed Jan. 8, 2013, the disclosure of which is hereby incorporated by reference herein in its entirety.

BACKGROUND OF THE INVENTION

1. Field of the Invention

The present invention relates to equipment for baseball and softball fields. More particularly, embodiments of the invention provide a double-sided home plate configured with an upper home plate and an opposing lower home plate, such that a first home plate can be used and then replaced by flipping the device over to reveal a second playing surface for use.

2. Description of Related Art

The home plate is one of the most recognized parts of a baseball and softball field, with the area surrounding home plate being the main focus of every ball game. Compared with the other bases, $1^{st}$, $2^{nd}$ and $3^{rd}$ base, the home plate is set into the ground such that its top surface is level with the ground. The overall pentagonal shape also aides in its uniqueness. Every batter that "steps up to the plate" hopes to ultimately cross it by scoring a run, while every catcher crouches behind the home plate to receive each pitch of the game. Home plates are also commonly used in bullpens.

Since the area of the home plate, including the batter's box, is constantly in contact with players during use, it is important to provide a home plate that is sufficiently durable to withstand the constant contact of players on the ball field. As with any object exposed to constant wear, home plates need constant replacement. The consistent exposure to the elements and to the rough interaction with baseball and softball cleats causes the surface of the home plate to wear and degrade over time. In response, home plates have evolved and have been developed in attempts to provide a safe, durable surface that is easy to replace or change when home plates become too worn for use.

When baseball first began, the home plate was comprised of stone or wood to mark the $4^{th}$ and final base. However, players soon realized that falling or sliding on such a surface had a high risk of injury. Rubber soon replaced stone and wood and is largely the material still used in most home plates today. While the material of the home plate has not changed much over recent years, there have been many attempts at improving how the home plate is secured in the ground and providing a surface that can quickly be changed.

To ensure the home plate does not come loose during a game, and remains in place for several games, an anchoring system for the home plate can be used. For example, U.S. Pat. No. 5,203,557 entitled "Baseball Base and Anchor," which is incorporated herein by reference in its entirety, describes an anchor that is placed and secured in the ground and connects to the anchor plate on the underside of the home plate. Though home plates secured in this way provide a stable structure, to reposition or adjust the base, the user must also reposition and adjust the anchor. Additionally, when a base needs replacing, the entire base, with the anchor plate, typically needs to be replaced. This provides a home plate that is not efficient or cost-effective to replace.

In anchoring systems the plate is typically relatively thin. To provide a more efficient means of adjusting and removing the home plate, plates have been developed with a substantial thickness so that the clay or dirt packed around the base is enough to secure it in place without an anchor. While a home plate without an anchor makes the base easier to remove, it still does not solve the problem of needing to replace the entire base once it shows signs of wear.

Some home plates provide a means of replacing just the surface of the home plate, as opposed to the entire base, such as that described in U.S. Pat. No. 7,648,432 entitled "Home Plate with Up-Tight Bevel," which is incorporated herein by reference in its entirety. This design provides a home plate in which the top plate is removable from the base and is secured with the base by anchor posts. Though the top plate is removable for easy replacement, the anchoring system used to secure the top plate with the rest of the base comprises many pieces that can be lost or damaged over time, especially in an environment constantly exposed to the elements and impact forces from contact with players.

Additional home plates provide a base comprised of a single rubber construction providing an easy to remove and install home plate. Even further, some plates provide a means of replacing only the top plate so that the rest of the base can remain in the ground at all times. Such home plates do not require anchors as the top plate just sits in the rest of the base. Although these plates can provide an efficient means of replacing home base, over time dirt or clay will get under the top plate and between the top plate and its base, thereby creating an undesirable "unsafe" and/or uneven surface.

Additional efforts in the development of bases for baseball are described in U.S. Pat. Nos. 2,138,273; 3,508,747; 3,572,705; 4,266,768; 4,448,414; 4,531,733; 4,591,154; and U.S. Patent Application Nos. 20080194361; 20090124436; 20100210382; and 20100279802, which are each incorporated herein by reference in their entireties. Despite the attempts to make a home plate that is easy to install and replace and yet is durable and long lasting, the prior art has failed to provide a home plate with such characteristics. There is still a need for a home plate with a durable and long lasting base, wherein the home plate is configured to be installed in the ground and a first playing surface used, then removed and flipped over once the first playing surface is worn to provide a second, unused playing surface for use.

SUMMARY OF THE INVENTION

Embodiments of the invention provide for an improved home plate, and more particularly for a double-sided home plate. The double-sided home plate is configured to provide two identical home plate surfaces disposed in opposition to one another on one durable base, such that the home plate may be removed from the ground and inverted so that the used side may be inserted into the ground and the previously unused side faces up for use in play.

In one aspect of the invention, embodiments provide a double-sided home plate for the game of baseball and softball comprising two opposed playing surfaces. Such double-sided home plates can comprise a support base with two opposing recesses each shaped to receive a home plate insert that serves as a playing surface.

Specifically provided is a double-sided home plate comprising: a pentagonal shaped support base comprising an upper 45 degree beveled edge and a lower 45 degree beveled edge separated from one another by a selected distance; a first upper recess disposed within and encircled by the upper beveled edge; a second lower recess disposed within and encircled by the lower beveled edge; wherein each recess has an opening, and the opening of the first recess opens in a direction opposite that of the opening of the second recess; first and second pentagonal shaped plate type inserts, the first insert disposed within the first upper recess and the second insert disposed within the second recess. The distance between the beveled edges can be selected such that, when measured from a top surface of the first insert to a top surface of the second insert, the double-sided home plate is 3 inches thick. Any thickness desired can be used, however, including from 1 inch, 2 inches, 3 inches, 4 inches, 5 inches or 6 inches thick.

Also provided is a home plate article of manufacture for the game of baseball and softball that is double-sided such that it provides two playing surfaces, comprising a first and second five-sided plate of equal dimensions, a five-sided support base with outer dimensions larger than the first and second-five sided plate, wherein the support base comprises a first and second recess on opposite sides configured to receive the first and second five-sided plates, wherein, when the first and second five-sided plates are disposed in the first and second recesses of the support base, the home plate provides for two playing surfaces to serve as home plate.

Additionally provided is a home plate article of manufacture for the game of baseball and softball that is double-sided such that it provides two playing surfaces, comprising a first and second five-sided plate of equal dimensions, and a five-sided support base with outer dimensions larger than the first and second five-sided plate, wherein the support base comprises a first and second recess on opposite sides configured to receive the first and second five-sided plates, and further comprises a first edge and a second edge disposed on the same sides of the support base as the first and second recesses at an outer perimeter of the support base such that the first edge surrounds the first recess and the second edge surrounds the second recess, wherein, when the first and second five-sided plates are disposed in the first and second recesses of the base, the home plate article of manufacture provides for two playing surfaces to serve as home plate.

The first edge and second edge may be beveled, but they also may be curvilinear or perpendicular. Some embodiments of the invention may include a support base with a first beveled edge and a second beveled edge, wherein the first recess is disposed within and encircled by the first beveled edge and the second recess is disposed within and encircled by the second beveled edge. Additionally, some embodiments may include a peripheral gap between the first beveled edge and the first recess and the second beveled edge and the second recess. Other embodiments of the invention may include a support base where the first beveled edge and second beveled edge are configured at 45 degrees. The beveled edges in embodiments can be at the same or different angles and can range from a bevel between 0 and 90 degrees, such as from 15 to 75 degrees, or from 30 to 60 degrees, or from 35 to 55 degrees. Also provided is a support base that may have a maximum thickness of 1-6 inches.

In other aspects, the first beveled edge and second beveled edge may each terminate at an inner end and an outer end, and the first beveled edge and second beveled edge may each form the hypotenuse of an imaginary isosceles right triangle such that the distance of the opposite side of the triangle is ¾ inches. The distance between the inner ends of the first beveled edge and second beveled edge may be 1½ inches such that the total distance between the outer end of the first beveled edge and the outer end of the second beveled edge may be 3 inches.

In other aspects, the first and second five-side plate each may have an outer surface when disposed in the support base, and the home plate article of manufacture may be three inches thick when measured from the outer surfaces of the first and second five-sided plates. The outer dimensions of the first and second five-sided plates may correspond to the dimension requirements for home plate specified in the Official Rules of Major League Baseball. The first and second five-sided plate and a five-sided support base may comprise EPDM 75 rubber or natural rubber with a Shore A hardness in the range of 70 to 80, 70 to 90, 60 to 90, or 80 to 90 and/or a minimal tensile strength in the range of 8 to 20 MPa, which stands for mega Pascal. The five-sided support base may have a minimum tensile strength of 10 MPa and the five-sided plate may have a minimum tensile strength of 16 MPa.

In other aspects, the home plate inserts may be joined with a corresponding recess through a slip fit connection. The slip fit connection may be sufficient to secure the home plate inserts in each recess such that the home plate inserts may be joined without a fastener. Other embodiments may employ one or more fasteners to secure the home plate inserts into the support base. The one or more fasteners can include projections on the home plate inserts that interlock with corresponding indentations or recesses on the support base, or vice versa, projections on the home plate inserts that interlock with corresponding projections on the support base, hook-and-loop fasteners, magnets, or a runner and groove configuration. The fastener can also include an adhesive, or any combination of these securing means.

In other aspects of the invention, the home plate can comprise a peripheral gap between the upper beveled edge and the first upper recess and a peripheral gap between the lower beveled edge and the second lower recess.

Also provided is a double-sided home plate with at least one removable protective film disposed on a home plate insert. Such protective cover is advantageous in that it serves to protect the surface of the home plate insert that faces the ground when the home plate is installed. The protective film can be removed when the double-sided home plate is removed from the ground and inverted to expose the previously unexposed surface of the home plate insert in a ready to use position.

Within the scope of embodiments of the invention is provided a method of using a double-sided home plate comprising: removing a double-sided home plate from the ground in which it is installed; inverting the double-sided home plate; and installing the home plate in the ground in its inverted position.

Methods of the invention can be used with any double-sided home plate described in this specification. Preferred methods may include installing, removing, inverting, and/or re-installing a double-sided home plate that comprises a support base with two opposing recesses with a home plate insert fixed in each of the recesses, and optionally a removable protective film disposed on one of the home plate inserts.

One mode of operation responsible for the inventive home plate's success is that the home plate provides a base with two useable home plate surfaces. In embodiments, the home plate surfaces are provided by plate type inserts disposed on opposite sides of a support base. Although existing home plate products provide multiple home plate surfaces by providing for interchangeable inserts, preferred embodiments of the invention comprise home plate inserts that are not removable from the support base. Embodiments of the invention are an improvement on existing products by providing multiple home plate surfaces on a double-sided support base.

The invention solves the problem of a durable home plate with multiple home plate surfaces. Embodiments of the home plate according to the invention can be made with rubber, silicone or any durable flexible material and comprise a single or multi-part construction. Preferred materials can for example include natural rubber, EPDM rubber (ethylene propylene diene monomer acrylonitrile) or butadiene rubber-poly vinyl chloride (NBR-PVC) blends for either or both of the support base and home plate inserts. Preferred embodiments can include 3-part devices comprising a single-piece support base and two plate type inserts disposed in or on the support base. In further preferred embodiments, the double-sided home plate comprises a single-piece support base with recesses on opposing planar surfaces of the support base and a plate type insert fixed in each recess to provide a double-sided home plate with two useable sides.

In preferred embodiments the home plate is capable of resisting buckling. Preferably, the material is natural rubber or EPDM 75 (a sulfur cured terpolymer of ethylene, propylene and diene), with a Shore A hardness of 75+/−5 or 85+/−5, a minimum tensile strength of about 8-20 MPa, which stands for mega Pascal, such as about 10 MPa, and an ultimate elongation (ASTM D412) of 450%. In embodiments, the core has a minimum of 10 MPa, while the surface has a minimum of 16 MPa. For example, the home plate of embodiments of the invention may be formed of any elastic composition currently in use, although other suitable compositions could alternatively be employed. In some embodiments, the material may be a hard rubber, or natural rubber. A person of ordinary skill in the art, with the benefit of this disclosure, would know the type of material to use. Such material must have sufficient integrity to withstand wear associated with a baseball or softball game. Representative polymers can include, without limitation, Buna-N (butadiene acrylonitrile), Neoprene (polychloroprene), EPR (ethylene propylene), silicone (polysiloxane), such as PENTASIL, fluorosilicone, fluro elastomers (fluorinated hydrocarbons), natural rubber, synthetic natural rubber (cis-1-4 polyisoprene), cis-1,4-polybutadiene, SBR (styrene butadiene), urethanes and polyurethanes (polyester/polyether urethane), butyl (isobutylene Isoprene), hydrin (epichlorohydrin), and hypalon (chlorosulfonated polyethylene), extruded polystyrene/ethylene-propylene-diene rubber blends to name a few. Additional representative polymers can also include, without limitation (listed as ISO 1629 Code (technical name)): ACM (polyacrylate rubber), AEM (ethylene-acryate rubber), AU (polyester urethane), BIIR (bromo isobutylene isoprene), BR (polybutadiene), CIIR (chloro isobutylene isoprene), CR (polychlorporene), CSM (chlorosulphonated polyethylene), ECO (epichlorohydrin), EP (ethylene propylene), EPDM (ethylene propylene diene monomer), EU (polyether urethane), FFKM (perfluorocarbon rubber), FKM (fluorinated hydrocarbon), FMQ (fluoro silicone), FPM (fluorocarbon rubber), HNBR (hydrogenated nitrile butadiene), IR (polyisoprene), or synthetic natural rubber, IIR (isobutylene isoprene butyl), NBR (acrylonitrile butadiene), PU (polyurethane), SEBS (styrene ethylene butylene styrene copolymer), VMQ (vinyl methyl silicone), XSBR (acrylonitrile butadiene carboxy monomer), XSBR (styrene butadiene carboxy monomer), YBPO (thermoplastic polyether-ester), YSBR (styrene butadiene block copolymer), and YXSBR (styrene butadiene carboxy block copolymer). The rubber can be vulcanized if desired. Indeed, the material of the home plate can be any polymeric material. Preferred materials are endowed with the properties of flexibility and extensibility, meaning that upon the application of force, the molecules of the polymers straighten out in the direction in which they are being pulled; on release from being extended, they spontaneously recover their normal, random arrangements.

Physical characteristics of the home plate material can include a Shore A hardness in the range of about 20 to about 100. Preferred embodiments can have a hardness ranging from about 30-90, or about 25-40, or about 35-95, or about 50-80, or about 60-90. The Shore A hardness can vary depending on the particular league of play and style of cleats worn. For example, for professional leagues, harder materials (e.g. Shore hardness of 60-90) may be preferred. A similar hardness may be desirable for any leagues in which metal cleats are worn. For Little League Baseball, or for any leagues in which non-metal cleats are worn, softer materials (e.g. Shore hardness of 25-40) may be preferred. The material can have a tensile strength ranging from about 200-6,000 psi, such as from about 500-2,500 psi, or from about 1,000-3,000 psi, or from about 200-800 psi, or from about 1,500-2,000 psi, or from about 2,000-3,500 psi. Another characteristic of the composition of the home plate can include a maximum elongation (extensibility) of up to 750%, such as from about 450-600%. For some applications the melting temperature or glass transition temperature of the home plate material may be important, especially in warm to hot climates or seasons. A melting temperature of about 25 or a glass transition temperature of about −70 is preferred. Materials resistant to radiation or ultraviolet radiation are also desirable. Materials capable of retaining shape throughout ranges of about −60 to about 315° C. are preferred. Even further, the home plate material can have good to excellent resilience (rebound). Other characteristics can include good tear and abrasion properties and good resistance to heat. In addition, the home plate typically retains good flexibility at low temperatures, while having good impact strength. Good compressive strength, impact strength, and resistance to Euler buckling are also desirable. A compressive strength of about 30 MPa is preferred. In designing testing experiments to determine if a material is acceptable for use in the invention, ASTM standards and tests should be used. For example, ASTM D-572 can be used to measure for rubber deterioration, or ASTM D-412 can be used for tensile strength, or ASTM D-624 for tear strength, or ASTM D-2240 for Shore hardness, or ASTM D-1817-05 can be used for density, or degradation in compression tests can be performed using ASTM D-623-07, while ASTM D-395, such as ASTM D395-03 (2008), can be used to measure compression set.

Embodiments of the invention can comprise material having any of the following characteristics, combinations of characteristics, or sets of characteristics: (i) density of about 1.12-1.19 g/cm$^3$, Shore A hardness of about 12-90, tensile strength of about 8-11.8 MPa, elongation at break of about 300-950%, tear strength of about 17-26 N/mm, rebound elasticity of about 45-60%, and compression set of about 25-55%; (ii) density of about 1.17-1.19 g/cm$^3$, Shore A hardness of about 60-75, tensile strength of about 10-11 MPa, elongation at break of about 450-500%, and tear strength of about 27-34 N/mm; (iii) density of about 1.13-1.17 g/cm$^3$, Shore A hardness of about 30-70, tensile strength of about 9-11 MPa, elongation at break of about 550-1,000%, tear strength of about 35-40 N/mm, rebound elasticity of about 45-55%, and compression set of about 25-45%; and (iv) density of about 1.13-1.16 g/cm$^3$, Shore A hardness of about 40-60, tensile strength of about 9-11 MPa, elongation at break of about 500-800%, tear strength of about 21-27 N/mm, rebound elasticity of about 42-47%, and compression set of about 15-35%.

The features of novelty and various other advantages that characterize the invention are pointed out with particularity in the claims forming a part hereof. However, for a better understanding of the invention, its advantages, and the objects obtained by its use, reference should be made to the drawings that form a further part hereof, and to the accompanying descriptive matter, in that there is illustrated and described a preferred embodiment of the invention. The features and advantages of the present invention will be apparent to those skilled in the art. While numerous changes may be made by those skilled in the art, such changes are within the spirit of the invention.

BRIEF DESCRIPTION OF THE DRAWINGS

The accompanying drawings illustrate certain aspects of some of the embodiments of the present invention, and should not be used to limit or define the invention. Together with the written description, the drawings serve to explain certain principles of embodiments of the invention.

DETAILED DESCRIPTION OF VARIOUS EMBODIMENTS OF THE INVENTION

Reference will now be made in detail to various exemplary embodiments of the invention. It is to be understood that the following discussion of exemplary embodiments is not intended as a limitation on the invention. Rather, the following discussion is provided to give the reader a more detailed understanding of certain aspects and features of the invention.

In accordance with embodiments of the present invention, the present invention relates to an improved home plate for ball fields, such as used in baseball or softball. Included is a home plate that is double-sided, where two playing surfaces disposed on opposite sides of the device are secured by a support base. The home plate is installed for use by inserting the double-sided home plate into the ground in a manner that provides for one playing surface to be exposed and the other to be hidden in the ground. When desired, the home plate can be removed from the ground, inverted to expose the previously hidden playing surface, and re-installed in the ground with the previously exposed surface now hidden in the ground. This invention is equally applicable to bases as well.

Figure 1A:
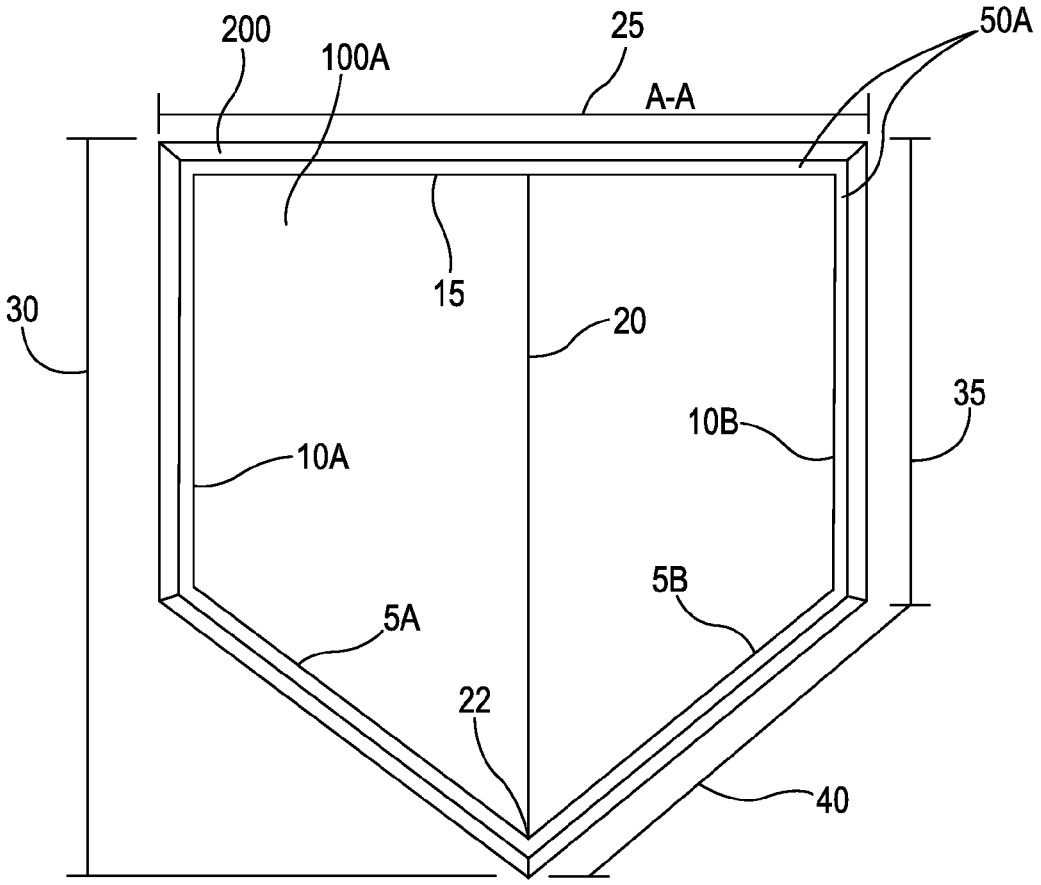
FIG. 1A is a schematic diagram illustrating a top planar view of a double-sided home plate according to an embodiment of the invention.

FIG. 1A provides a top planar view of a home plate according to embodiments of the invention. The outer dimensions of the plate correspond to the specifications listed in Rule 1.05 of the Official Rule Book of Major League Baseball, which is hereby incorporated by reference herein in its entirety. Generally, a top planar surface 100A of the home plate is pentagonal shaped with one 17 inch side 15, two sides 10A and 10B measuring 8.5 inches and two sides 5A and 5B measuring 12 inches. The two 12 inch sides 5A and 5B come together at a 90 degree angle to make a point 22 opposite the 17 inch side 15, and the length 20 from the 17 inch side down the centerline to the point 22 is 17 inches, so that the top planar surface is essentially a 17 inch square with two of the corners removed. The home plate also provides a bottom planar surface of the same dimensions (not shown). This provides a double-sided home plate with two useable home plate surfaces. Preferably, the home plate surfaces are provided by plate type inserts disposed on a support base 200 or in a recess of a support base 200. The support base is preferably the same rectilinear shape as the top and bottom plates, but slightly larger in the dimensions. Embodiments may include a support base that is the same pentagonal shape as the top and bottom plate, but wherein each side is anywhere from 5%-25% larger than the top and bottom plate, including 10%, 15%, and 20% larger. In an exemplary embodiment, the support base is a pentagon which has in its maximum outer dimensions a 19 inch side as shown by reference line 25, two 10 inch sides as shown by reference line 35, and two 13½ inch sides as shown by reference line 40, and is 20½ inches long from the centerline from reference line 25 to the point, as shown by reference line 30. Also shown in FIG. 1A is an optional gap 50A surrounding the home plate insert 100A and disposed between the peripheral edge of the home plate insert 100A and the outer edge of the support base 200. The gap 50A may be 1/16 inches to ¼ inches in width, and is preferably ⅛ inches. When the home plate is flipped over, that is, inverted, it will present to the user a playing surface that is identical to the previously exposed playing surface since it comprises an identical structure on the opposite side of the support base 200. In embodiments, the home plate can comprise only one playing surface if desired, or more than one playing surface.

Figure 1B:
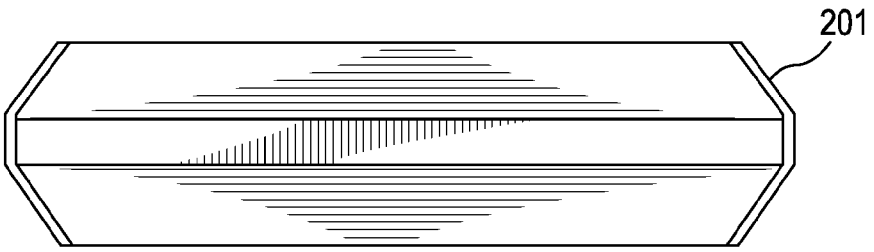
FIG. 1B is a schematic diagram illustrating a side elevation view along reference line A-A of FIG. 1A according to an embodiment of the invention.

FIG. 1B is a side elevation view of a double-sided home plate. As shown, the double-sided home plate can comprise a beveled edge 201 around each playing surface. The beveled edges 201 can meet one another or can be spaced apart a desired distance from one another. If the edges 201 are spaced apart from one another, the overall thickness of the double-sided home plate can be adjusted to a desired thickness or height. Preferably, double-sided home plates of the invention are from 1-5 inches thick, such as from 2-4 inches thick, such as 3 inches thick. The thickness in embodiments can be measured from the top playing surface of the home plate to the bottom playing surface of the home plate. In embodiments, the playing surfaces of the home plate can also be referred to as a home plate insert, such as in embodiments where the insert is disposed into and fixed within a recess of the support base.

Figure 2A:
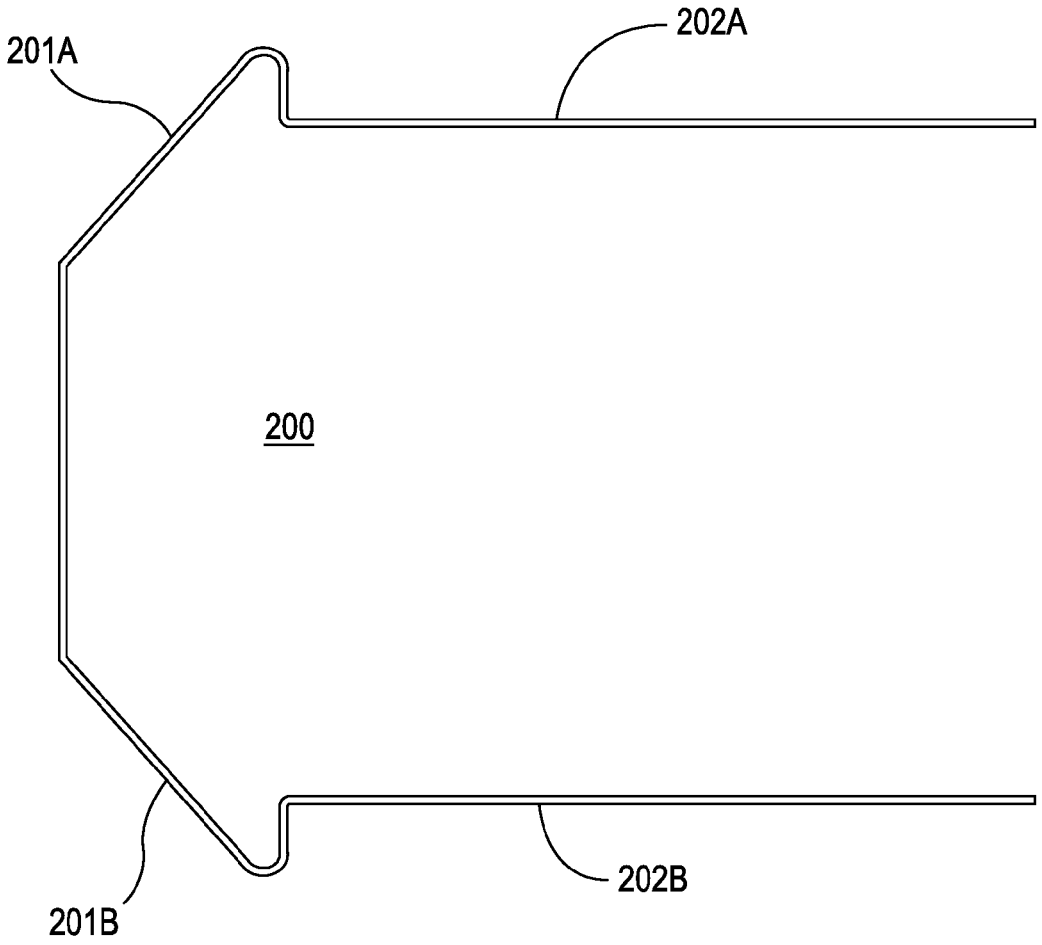
FIG. 2A is a schematic diagram illustrating a cross-sectional view of a portion of a home plate support base along an end portion of reference line A-A of FIG. 1A, wherein the support base has a recess of uniform depth according to an embodiment of the invention.
Figure 2B:
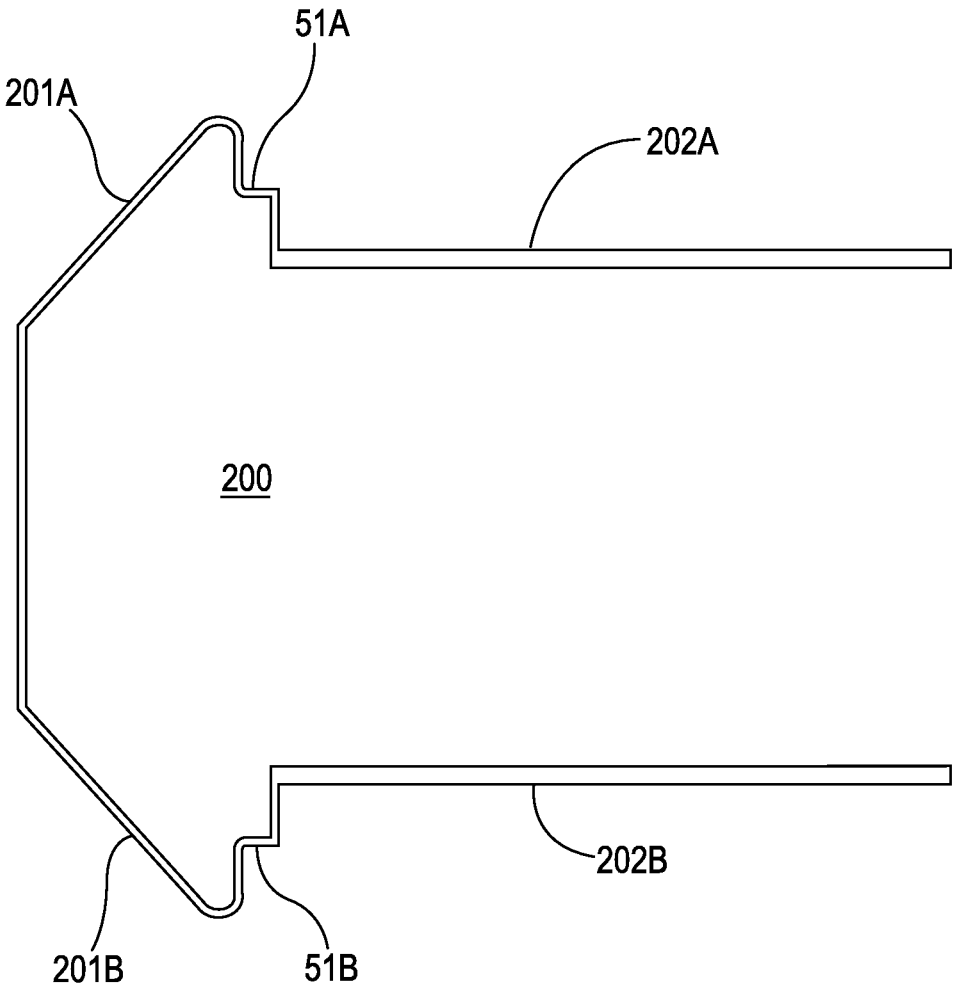
FIG. 2B is a schematic diagram illustrating a cross-sectional view of a portion of a home plate support base along an end portion of reference line A-A of FIG. 1A, wherein the support base has a recess with a stepped-up configuration according to an embodiment of the invention.
Figure 3:
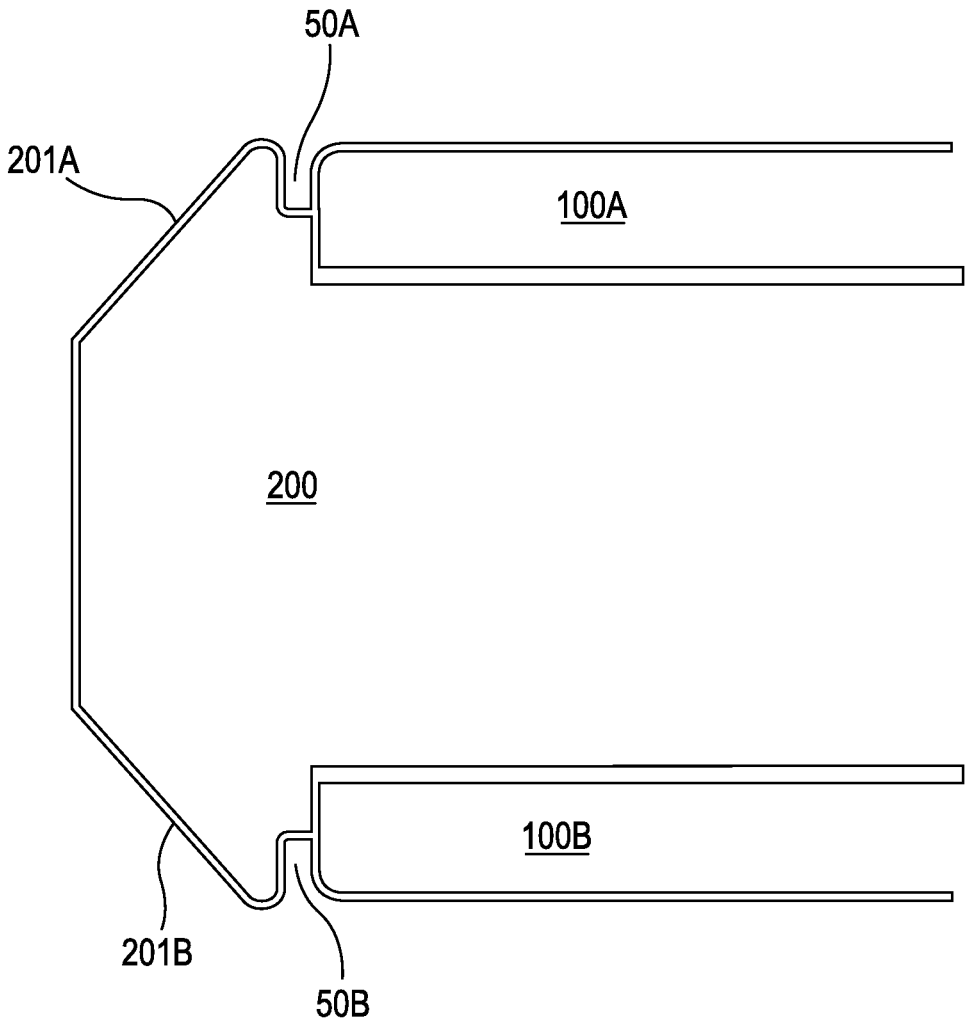
FIG. 3 is a schematic diagram illustrating a cross-sectional view of a portion of a home plate support base along an end portion of reference line A-A of FIG. 1A, wherein each plate insert is disposed in the recess of the support base.

FIG. 2A, FIG. 2B and FIG. 3 provide cross-sectional views of a portion of a double-sided home plate according to embodiments of the invention. As shown, embodiments of the invention provide an outside portion with two inside recesses 202A and 202B (FIGS. 2A and 2B) or plate inserts 100A and 100B disposed in the recesses (FIG. 3) on opposite sides of the outer portion. The outside portion can also be referred to as the support base 200. In preferred embodiments each home plate insert 100A and 100B is disposed in a correspondingly shaped and sized recess 202A and 202B of the support base in a manner to provide for a slip fit, which preferably has no signs of buckling or separation between surfaces, ie, the surface of the recess and the surface of the home plate insert. Embodiments may also be secured by an adhesive such as glue or rubber cement, or the home plate insert can be fused to the support base. In preferred embodiments the overall height or thickness of the home plate is 3 inches, with each home plate insert comprising a thickness in the range of about 0.5 inches to about 2 inches. Although the cross-sectional view illustrates the home plate insert 100A being flush with the top of the beveled edge 201 of the support base, in embodiments the thickness of the home plate insert can be such that its upper surface is not flush with the beveled edge, such as is disposed above or below the beveled edge. As long as the home plate is double-sided, comprising a playing surface on two opposing sides, embodiments will still be seen as within the scope of the current invention. Preferred embodiments are such that the double-sided home plate provides two identical sides.

In preferred embodiments, and as illustrated in FIG. 2A, FIG. 2B and FIG. 3, the core, or center, of the double-sided home plate comprises a thickness of about 2 inches. This is the distance between the two opposing recesses. This thickness can be adjusted depending on the material used for the support base to preferably provide a core capable of withstanding a force of 10 MPa or greater. Further preferred are embodiments of a double-sided home plate, where the home plate when inserted in the support base is capable of withstanding a force of 16 MPa or greater. It is also preferred that embodiments of the double-sided home plate meet ASTM standard of Ozone resistance ASTMD 11571.

As shown in FIGS. 2A and 2B, embodiments of the invention provide a dual-sided home plate with a support base 200 comprising a beveled edge 201A surrounding an upper recess 202A and a beveled edge 201B surrounding a lower recess 202B. In some embodiments it may be preferred to have no beveled edges. These embodiments may include sides that are vertical to the playing surfaces of the home plate inserts and are thus parallel to one another, or sides that are curvilinear, such as configured in a semi-circle. In embodiments with beveled edges, the angle of the bevel can provide sides with a slope ranging from 10 to 80 degrees, such as from about 15-75 degrees, or from about 20-70 degrees, or from about 25-60 degrees, or from about 30-50 degrees, or from about 35-45 degrees. Edge height can also range from about 0-3 inches, such as from about ¼ inch to about 2 inches, or from about ½ inch to about 1 inch, or be about ¾ inch. As illustrated in FIGS. 2A and 2B, which shows an edge height of about ¾ inch, this measurement is preferably taken as a perpendicular measurement starting from a point where the bevel begins to a point where the bevel ends. The beveled edges 201A and 201B of the dual-sided home plate can be used to provide a guide for how far to secure the home plate in the clay of the field. The recesses 202A and 202B can also be provided in various depths, with each recess having the same or different depths. For example, the recesses 202A and 202B can be about ⅛ to ¼ to ½ to 1 inch deep. In a preferred embodiment the recesses 202A and 202B are ½ inch deep. The recesses 202A and 202B may have a uniform depth such as the embodiment shown in FIG. 2A. In other embodiments, the recesses 202A and 202B may provide a stepped configuration wherein each recess steps up at the outer perimeter 51A and 51B of the recesses 202A and 202B, as shown in the embodiment depicted in FIG. 2B. In a specific embodiment, the maximum depth of the recesses 202A and 202B are ½ inch deep, and they step up at the outer perimeters 51A and 51B at a ¼ inch depth. In other embodiments the recess on one side of the support base of the home plate is ½ inch deep, while the recess on the opposing side of the support base is 1 inch deep, or any other combination of depths. When using identical home plate inserts 100A and 100B in each recess 202A and 202B and differing recess depths on opposing sides of the support base, such an embodiment can be used to provide a double-sided home plate with the home plate surface on one side of the device flush with the surrounding edge and a home plate surface on the opposing side that extends above or below the edge to provide the user with a choice of exposed surface height options.

As shown in FIG. 1 and FIG. 3, home plate inserts 100A and 100B may fit in recesses 202A and 202B that are larger than the perimeter of the inserts 100A and 100B such that a gap 50A and 50B exists between the inserts 100A and 100B and the edge of the recesses 202A and 202B. Such a gap can also be provided by the stepped configuration. The home plate inserts 100A and 100B may fit the recesses 202A and 202B through a slip fit connection. In preferred embodiments, the connection between the home plate inserts 100A and 100B and support base 200 is such that no fastener is required to secure the home plate inserts 100A and 100B into the support base as the slip fit connection is sufficient to secure them. In other embodiments, one or more fasteners are used to secure the home plate inserts into the support base. The one or more fasteners can include one or more projections on the home plate inserts that interlock with one or more corresponding indentations or recesses on the support base, or one or more recesses or indentations on the home plate inserts that interlock with one or more corresponding projections on the support base, or one or more projections on the home plate inserts that interlock with corresponding projections on the support base, hook-and-loop fasteners, magnets, adhesive such as glue or rubber cement, or a runner and groove configuration, or any combination of these.

In embodiments the interior portion on the home plate (ie, the home plate insert) is white, with a bright gloss white finish or color. The exterior portion (ie, the support base) is black or gloss black. Additionally, the inside portion is flat within ⅛ inch tolerance when measured across the total surface of the interior portion. Moreover, in preferred embodiments the upper surface to lower surface does not deviate more than ⅛ inch when compared to the bottom surface of the exterior portion between the upper and lower surfaces.

Embodiments of the invention also include a method of using the double-sided home plate. Such methods include using a double-sided home plate by removing a double-sided home plate from the ground in which it is installed; inverting the double-sided home plate; and installing the home plate in the ground in its inverted position. More particularly, the double-sided home plate is inserted in the ground by a user, typically a groundskeeper, in a pre-dug hole in the shape of the home plate, but slightly larger. The home plate may be located such that the point meets the intersection of the first and third base foul lines and the two 12 inch sides are aligned with the first and third base foul lines. Alternatively, the home plate may be inserted into the ground of a bullpen to provide a target for pitching practice or warm up. The home plate comprises one playing surface that is exposed, with the opposite playing surface covered with a removable polyethylene sheet. The exposed side or unprotected playing surface should be facing up out of the ground with the protected side inserted into and hidden in the ground. Similar to existing home plates, once inserted into the ground, clay or dirt is added around the home plate so that just the beveled edge of the support base and the upper playing surface are exposed. Once the exposed side becomes worn, the home plate is removed from the ground, flipped over to expose the other playing surface, and the polyethylene sheet is removed. The home plate is then again inserted into the ground, with the new surface exposed face up and the worn surface face down and hidden in the ground. Dirt or clay is then packed in around the home plate so that just the beveled edge of the exterior portion and the new playing surface are exposed for play. Preferred double-sided home plates that can be used in such methods include a double-sided home plate comprising a support base with two opposing recesses with a home plate insert fixed in each of the recesses, and optionally a removable protective film disposed on one of the home plate inserts. When the home plate is in the ground with one playing surface exposed, the opposite side is protected from the clay by a removable polyethylene sheeting cover, preferably about 6 mm thick, that is glued to the support base. When the first exposed side becomes worn, the home plate is simply removed and flipped over, and the polyethylene sheet is removed to expose the new top surface of the plate.

The present invention has been described with reference to particular embodiments having various features. It will be apparent to those skilled in the art that various modifications and variations can be made in the practice of the present invention without departing from the scope or spirit of the invention. One skilled in the art will recognize that the features of embodiments of the invention may be used singularly or in any combination based on the requirements and specifications of a given application or design, and one or more elements, constituents, or process steps may be omitted, incorporated, or altered as desired. Other embodiments of the invention will be apparent to those skilled in the art from consideration of the specification and practice of the invention. To this end, it is intended that the specification and examples be considered as exemplary in nature and that variations that do not depart from the essence of the invention are intended to be within the scope of the invention.

Further, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. It should be evident that the particular illustrative embodiments disclosed above may be altered or modified and all such variations are considered within the scope and spirit of the present invention. While systems and methods are described in terms of "comprising," "having," "containing," or "including" various components or steps, the systems and methods can also "consist essentially of" or "consist of" one or more of the various components or steps. All numbers and ranges disclosed in this specification may vary by some amount. Whenever a numerical range with a lower limit and an upper limit is disclosed, any number and any included range falling within the range is specifically disclosed. Additionally, it is understood that the values provided for dimensions of various features can be endpoints to any range falling within the dimensions disclosed. In particular, every range of values disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one, at least one, or more than one of the element it introduces. The term "about" is understood to mean plus or minus 10% of the amount disclosed. All references cited in this specification are hereby incorporated by reference herein in their entireties. If there is any conflict in the usages of a word or term in this specification and one or more patent or other documents cited herein, the definitions consistent with this specification should be adopted.

The invention claimed is:

1. A home plate article of manufacture for the game of baseball that is double-sided such that the home plate article of manufacture provides two playing surfaces, comprising:

a first and second five-sided plate of equal dimensions; and a five-sided support base with outer dimensions larger than the first and second-five sided plate, wherein the support base comprises a first and second recess on opposite sides configured to receive the first and second five-sided plates, and further comprises a first edge and a second edge disposed on the same sides of the support base as the first and second recesses at an outer perimeter of the support base such that the first edge surrounds the first recess and the second edge surrounds the second recess;

wherein, when the first and second five-sided plates are disposed in the first and second recesses of the support base, the home plate article of manufacture provides for two playing surfaces to serve as home plate.

2. The home plate article of manufacture of claim 1, wherein the first edge and second edge are beveled.

3. The home plate article of manufacture of claim 2, wherein there is a peripheral gap between the first beveled edge and the first recess and the second beveled edge and the second recess.

4. The home plate article of manufacture of claim 2, wherein the first beveled edge and second beveled edge are configured at a 45 degree angle relative to a side of the support base.

5. The home plate article of manufacture of claim 1, wherein the support base has a maximum thickness of 3 inches.

6. The home plate article of manufacture of claim 1, wherein the first and second five-sided plates may engage with the first and second recesses of the support base through a slip-fit connection and an adhesive.

7. The home plate article of manufacture of claim 6, wherein the slip-fit connection is sufficient to secure the first and second five-sided plates.

8. The home plate article of manufacture of claim 1, wherein the outer dimensions of the first and second five-sided plates correspond to the dimension requirements for home plate specified in the Official Rules of Major League Baseball.

9. The home plate article of manufacture of claim 1, wherein the first and second five-sided plate and a five-sided support base comprise natural rubber with a Shore A hardness in the range of 60 to 90 and a minimal tensile strength in the range of 8 to 20 MPa.

10. The home plate article of manufacture of claim 9, wherein the five-sided support base has a minimum tensile strength of 10 MPa and the five-sided plate has a minimum tensile strength of 16 MPa.

11. The home plate article of manufacture of claim 1 comprising a removable protective film disposed on each of the first and second five-sided plates.

* * * * *